US005413296A

United States Patent [19]

LaFontaine

[11] Patent Number: 5,413,296

[45] Date of Patent: May 9, 1995

[54] PAINT CAN AND PAINTBRUSH HOLDING APPARATUS

[75] Inventor: Roy A. LaFontaine, Port Colborne, Canada

[73] Assignee: Inventures Niagara Inc., Welland, Canada

[21] Appl. No.: 62,018

[22] Filed: May 17, 1993

Related U.S. Application Data

[60] Continuation-in-part of Ser. No. 906,897, Jun. 26, 1992, abandoned, which is a division of Ser. No. 628,602, Dec. 17, 1990, Pat. No. 5,145,226.

[51] Int. Cl.[6] ..... E06C 7/14

[52] U.S. Cl. ..... 248/210; 248/224.3; 248/312.1

[58] Field of Search ..... 248/111, 113, 110, 312.1, 248/210, 213.2, 224.3

[56] References Cited

U.S. PATENT DOCUMENTS

| | | | |
|---|---|---|---|
| 1,496,346 | 6/1924 | Lindmark | 248/111 |
| 2,541,390 | 2/1951 | Weigand | 248/210 |
| 2,993,672 | 7/1961 | Bower et al. | 248/312.1 X |
| 3,278,148 | 10/1966 | Denaro | 248/312.1 |
| 3,407,429 | 10/1968 | Nardo | 248/110 X |
| 3,536,285 | 10/1970 | Vaughn | 248/110 X |
| 3,822,846 | 7/1974 | Jesionwski | 248/210 |
| 4,436,217 | 3/1984 | Ritter | 248/110 X |
| 4,991,803 | 2/1991 | Buder | 248/213.2 X |
| 5,076,519 | 12/1991 | Panovic | 248/110 |

*Primary Examiner*—David M. Purol

*Attorney, Agent, or Firm*—Hodgson, Russ, Andrews, Woods & Goodyear

[57] ABSTRACT

Paint can and paintbrush holding apparatus. A paint can is mountable to a step-ladder by a paint can holder having a handle which may be inserted in a hollow ladder rung. A second member is detachably attachable to the top plate of a step-ladder and disposes an elongate member for engagement with the handle for alternatively mounting the paint can to a step-ladder. A paintbrush holder is composed of air impermeable material and shaped and sized to retard air flow to the paintbrush bristles to maintain their moistness for perhaps at least an hour during temporary cessation of painting and to maintain during that time the shape of the bristles. The paintbrush holder includes a clip for attachment thereof to a paint can rim with the holder hanging along the outer surface of the paint can. The clip is shaped and sized to permit easy yet secure attachment whereby inadvertent detachment may be prevented.

6 Claims, 4 Drawing Sheets

Fig. 1.
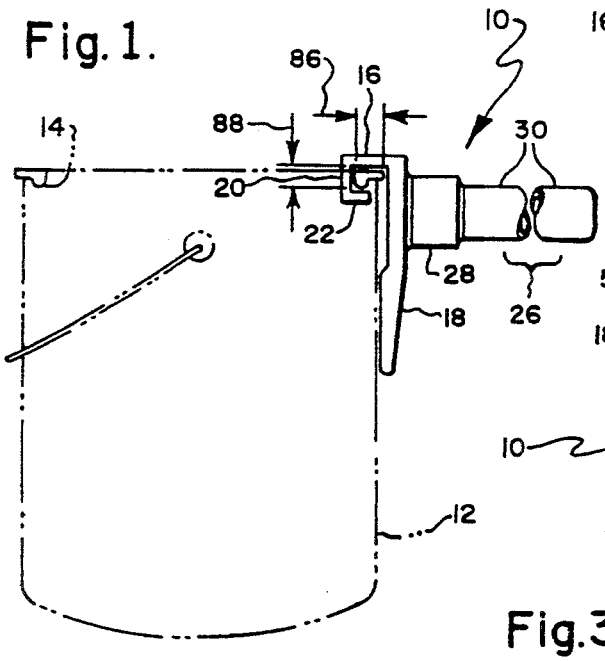
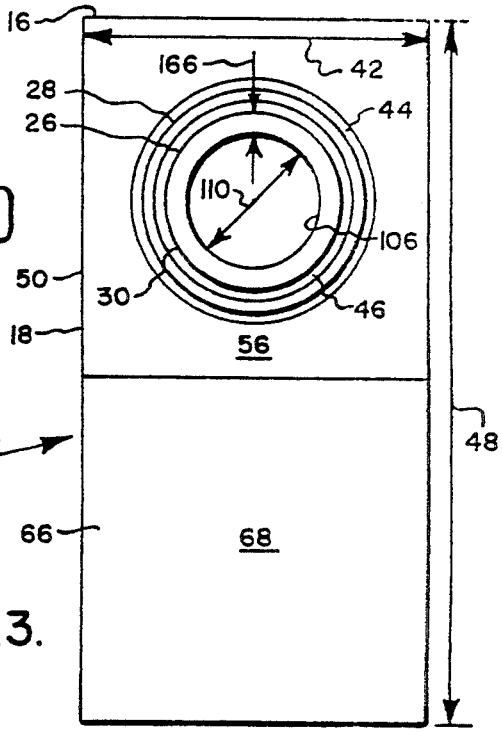
Fig. 3.
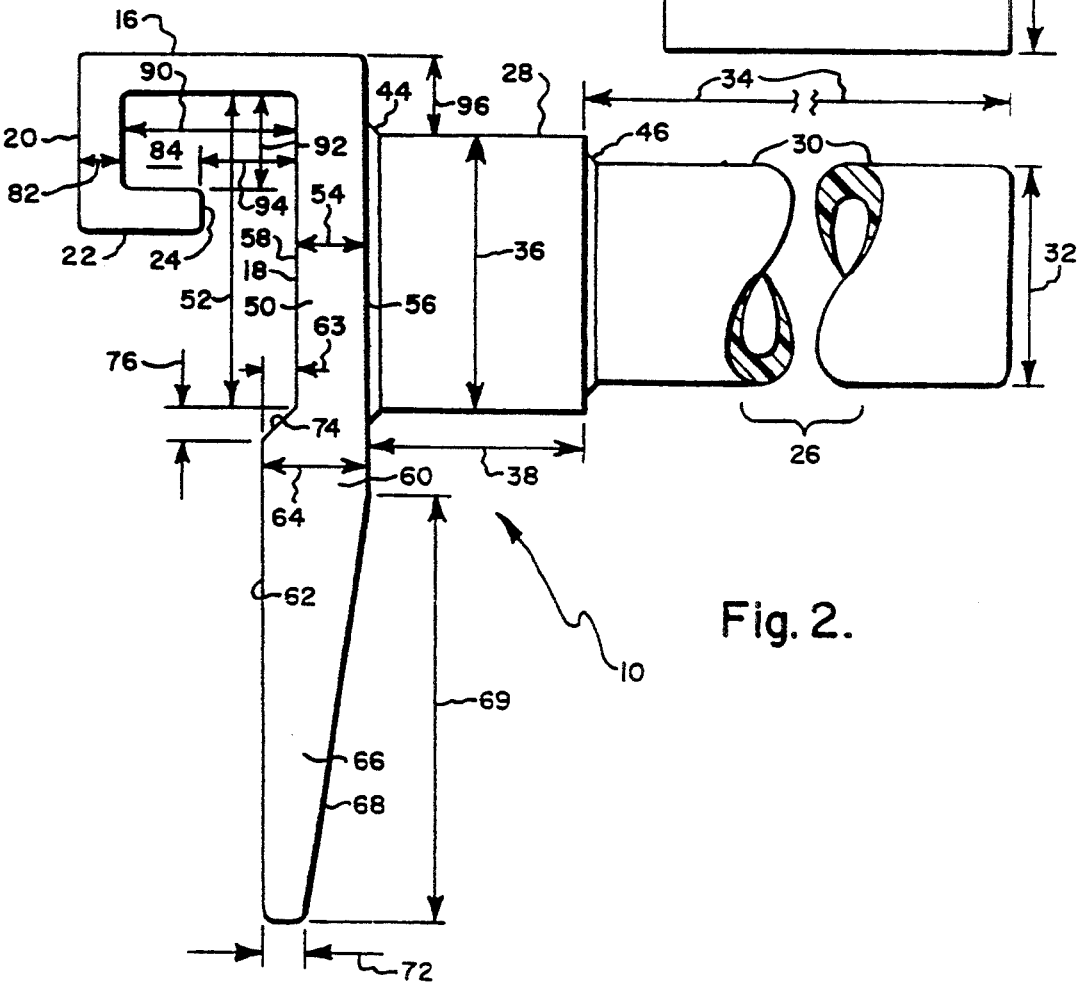
Fig. 2.

Fig. 4.
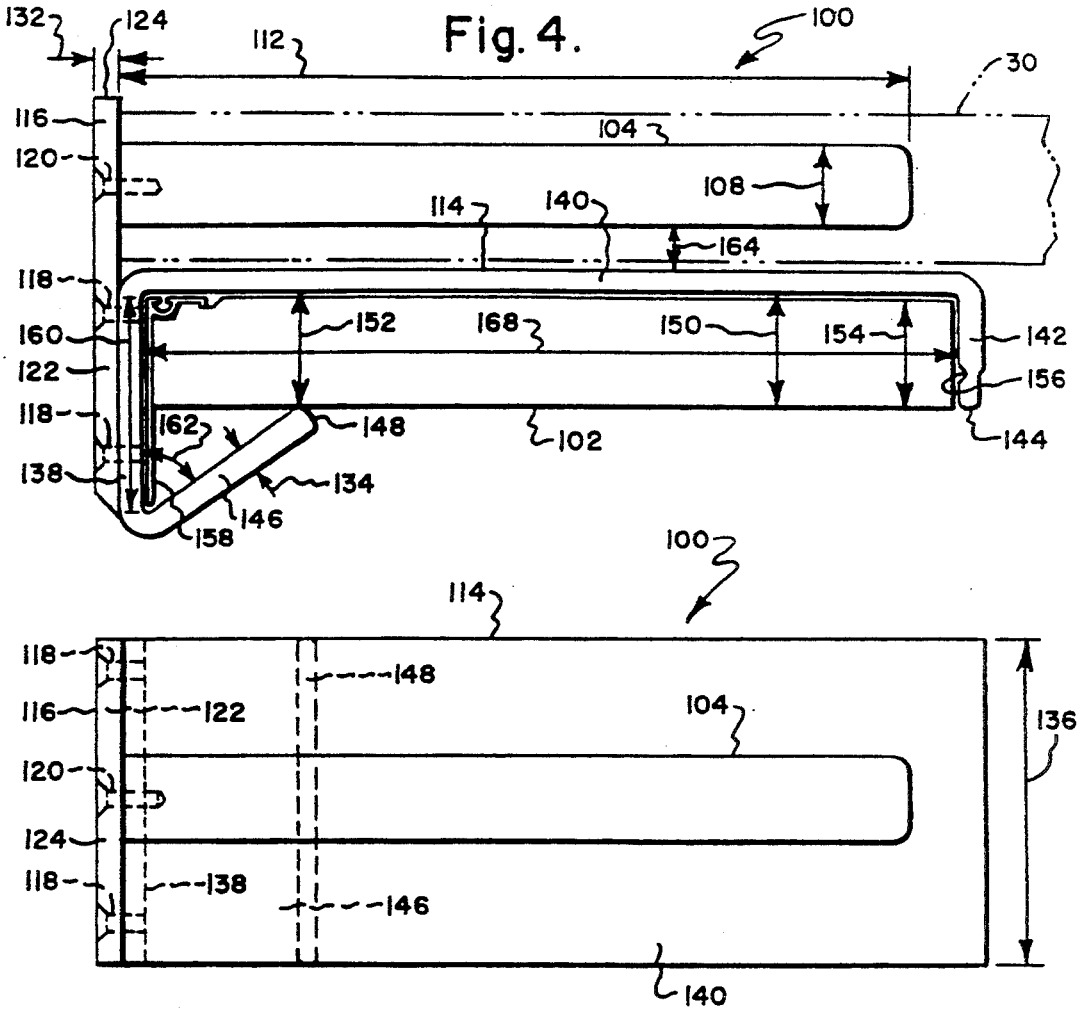
Fig. 5.
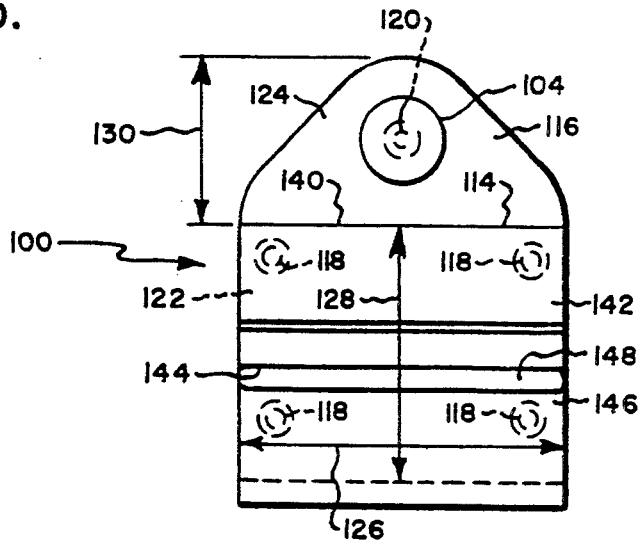
Fig. 6.

PAINT CAN AND PAINTBRUSH HOLDING APPARATUS

This application is a continuation-in-part of U.S. patent application Ser. No. 07/906,897, filed Jun. 26, 1992, now abandoned which is a divisional of U.S. patent application Ser. No. 07/628,602, filed Dec. 17, 1990, now U.S. Pat. No. 5,145,226, the disclosures of which patent and prior applications are incorporated herein by reference.

The present invention relates to paint can holders, i.e., holders which provide handles for paint cans and means for mounting the paint cans to a ladder. The present invention also relates to receptacles f or paintbrushes.

Art which may be of interest to the present invention includes the following U .S. patents:

| | |
|---|---|
| 1,221,658 | Berry |
| 1,858,656 | Batherman |
| 1,862,701 | Moelter et al |
| 1,900,636 | Davis |
| 2,536,215 | Povondra |
| 2,542,737 | Vogel |
| 2,544,312 | Hamilton |
| 2,560,228 | Kosorok |
| 2,803,375 | Meshberg |
| 2,846,173 | Grovesteen |
| 2,912,205 | Toune |
| 3,131,900 | Anderson et al |
| 3,223,369 | Benninger, Jr. |
| 3,822,846 | Jesionowski |
| 3,981,044 | Luebke et al |
| 4,023,702 | McKnight |
| 4,025,016 | Brothers |
| 4,036,463 | Hopkins et al |
| 4,099,693 | Blann |
| 4,101,046 | Puntillo |
| 4,186,903 | Fazakerley |
| 4,534,528 | Rousseau |
| 4,560,127 | Ippolito |
| 4,702,446 | Brown |
| 4,824,060 | Korda |
| 4,919,298 | Gregory |
| 1,496,346 | Lindmark |
| 2,541,390 | Weigand |
| 2,993,672 | Bower et al |
| 3,278,148 | Denaro |
| 3,407,429 | Nardo |
| 3,536,285 | Vaugh |
| 4,436,217 | Ritter |
| 4,991,803 | Buder |
| 5,076,519 | Panovic |
| 1,178,965 | Stroecker |
| 2,453,670 | Persson |
| 2,493,751 | Davis |
| 2,524,875 | Beaver |
| 2,610,885 | Hayden |
| 3,189,937 | Sciortino |
| 3,304,112 | Elliott |
| 4,396,174 | Continenza et al |

Other art of interest includes the following Canadian patent documents:

| | |
|---|---|
| 78265 | Raymond, II |
| 311830 | Lissy |
| 348410 | Neisworth |
| 240388 | Lindmark |
| 540396 | Gotisagen et al |
| 708482 | Richard |
| 857167 | Metcalf |
| 955225 | Miilar |

The following Canadian industrial design patent documents may also be of interest:

| | | |
|---|---|---|
| | 53635 | Hamilton & Co. (London) Limited |
| | 15531 | The French Ivory Products Limited |
| | 26174 | T. S. Simms and Co. Limited |
| Appl. No. | 51.10 | Bux |
| | 57009 | Wiltshire Consolidated Limited |
| | 50110 | Pelletier |
| | 13330 | Goldring |
| | 52004 | Fortier |

British patent documents 683,720 and 1,544,265 may also be of interest.

Various paint can holders which have been proposed are either too complicated for general use, do not sufficiently secure the paint can, do not adequately mount the paint can to a ladder, or otherwise have disadvantages which make them impractical for use by a do-it-yourself and/or professional painter. Likewise, various paintbrush holders which have been proposed are too complicated, are not adequately securable to the outside of a paint can for the convenience of the user, do not adequately guard the paintbrush from drying out when not in use, or otherwise have disadvantages which do not make them practical for use by a do-it-yourself and/or professional painter.

Accordingly, it is an object of the present invention to provide apparatus which reliably allows a paint can to be readily, easily, and securely mounted to a ladder.

It is a further object of the present invention to provide a low cost non-complicated paintbrush holder which may be reliably and securely attached to the side of a paint can so that it is easily usable.

It is yet another object of the present invention to provide such a paintbrush holder which keeps the paintbrush bristles from drying out for a long period of time during temporary cessation of painting so that the brush bristles remain moist and ready for re-use.

In accordance with the present invention, apparatus for mounting a paint can to a step-ladder comprises a paint can holder which has a handle portion for holding by a painter or for insertion in a hollow rung of a ladder for mounting the paint can thereon. The paint can holder may alternatively be attached to a step-ladder by means of a second member which is attachable to a step-ladder top plate and which includes an elongate cylindrical portion, and the handle portion may be tubular for receiving the cylindrical elongate portion. Also in accordance with the present invention, a paintbrush holder is provided which is composed of a material which is impermeable to air and has walls which are tapered and sized to receive the bristles of the paintbrush with the bristle casing of the paintbrush substantially blocking the passage of air to the bristles, and the paintbrush holder may be securely clipped to the paint can rim to ensure against accidental detachment thereof. The paintbrush holder is clipped to the rim to hang along the outside of the paint can.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE DRAWINGS

FIG. 1 is a side view of a paint can holder which embodies the present invention and which is illustrated attached to a paint can.

FIG. 2 is an enlarged side view of the paint can holder of FIG. 1.

FIG. 3 is an enlarged end view of the paint can holder of FIG. 1. FIG. 4 is a side view of a member attachable to a step-ladder member for providing means for engaging the paint can holder of FIG. 1 for mounting of a paint can on a step-ladder.

FIG. 5 is an upper view of the member of FIG. 4.

FIG. 6 is an end view of the member of FIG. 4.

DETAILED DESCRIPTION OF THE PREFERRED EMBODIMENTS

Figure 7:
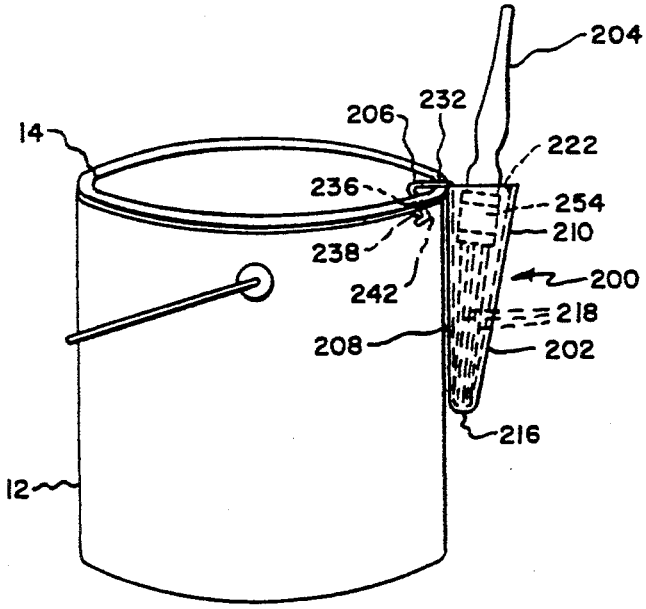
FIG. 7 is a side view of a paintbrush holder which embodies the present invention and which is illustrated clipped to a paint can and with a paintbrush therein.
Figure 10:
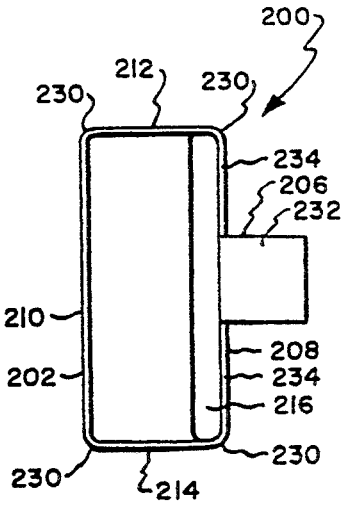
FIG. 10 is an enlarged top view of the paintbrush holder of FIG. 7.
Figure 8:
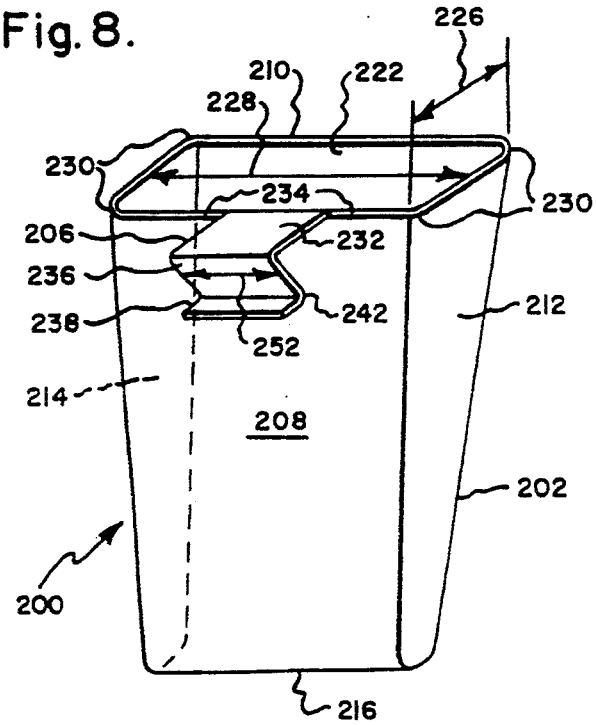
FIG. 8 is an enlarged perspective view of the paintbrush holder of FIG. 7.

Referring to FIGS. 1 to 3, there is shown generally at 10 a paint can holder for attachment to a paint can, illustrated at 12, which may be a conventional one-gallon can having a conventional upper rim 14 for receiving a lid. While the present inventor is described specifically for use with one-gallon paint cans, it should be understood that the teachings hereof may be used to provide the invention for use with paint cans of other sizes such as quart paint cans.

The paint can holder 10 comprises a rigid member which, although it may be composed of more than one piece suitably rigidly joined, is preferably a single rigid piece. Preferably, the paint can holder 10 is injection molded as a single piece composed of a suitable material such as, for example, 35 percent glass-filled nylon with ultraviolet light stabilizer or a suitable polyacetal material having a holding strength capability sufficient for the weight of the paint to be picked up thereby. For example, for a one-gallon paint can holder, the holding strength capability may perhaps be sufficient to hold two gallons of paint, thus allowing a margin of safety. It should be understood, however, that any other suitable rigid material may be used for the paint can holder 10.

The paint can holder 10 has an elongate first portion 16 which, when the holder is attached to the paint can, extends across and generally engages the top of the rim 14. An elongate second portion 18 extends downwardly from one end of the first portion 16 and generally engages the outer surface of the paint can 12. Extending downwardly from the other end of the first portion 16 and generally engaging the inner annular vertical surface of the rim 14 is an elongate third portion 20. Extending from the lower end of the third portion 20 in a direction toward the second portion 18 and generally engaging the lower surface of the rim 14 is an elongate fourth portion 22. Thus, the rim is generally enclosed within the space, illustrated at 84, defined by generally flat or planar portions 16, 20, and 22 and the side of the paint can, but the portions 16, 20, and 22 do not all necessarily touch the rim at any given time. Fourth portion 22, which is also generally flat or planar, extends to an end or point of termination, illustrated at 24, which is spaced from the second portion 18 for reasons which will be discussed hereinafter. Extending cantileverly outwardly from the second portion 18, i.e., in a radial direction away from the paint can as the paint can holder is attached thereto, is a fifth portion 26 which serves as a handle. If desired to simplify manufacture, handle portion 26 may be manufactured separately and suitably attached to the remainder of the holder 10.

A first segment 28 of the handle 26 is generally cylindrical in shape and joins the second portion 18 and extends outwardly therefrom. A second segment 30, which may be said to constitute the handle proper, joins and extends outwardly from the first segment 28 and is also cylindrical but of a reduced diameter.

The handle 26 is sized so that it may fit within a hollow rung of a ladder, such as the open end of the hollow rungs shown in U.S. Pat. Nos. 3,223,369 to Benninqer, Jr., 4,099,693 to Blann, 4,186,903 to Fazakerley, or 4,702,446 to Brown, which patents are hereby incorporated herein by reference. The inner diameter of a hollow rung of a ladder may perhaps be greater than 1 inch and less than $1\frac{1}{4}$ inches. Many ladder rungs are D-shaped with the distance, in cross-section, along the straight side internally being typically between about $\frac{3}{4}$ inch and $1\frac{1}{2}$ inches. While the diameter of the second segment should not be so large that it does not fit within the hollow ladder rung, it should desirably be sufficiently large to provide a secure fitting therein. Thus, in order for the handle portion 26 to be securely but removably received in a typical hollow ladder rung, the outer diameter, illustrated at 32, of the second segment 30 may perhaps be about 1 inch. The handle portion 26 should extend far enough into the ladder rung that it provides a sufficiently secure but removable mounting thereto. Thus, the second segment 30 may nave a length, illustrated at 34, which is at least about 5 inches, more preferably about 6 inches. The first segment 28 is preferably sized to provide a stop or shoulder to prevent further entrance of the handle portion 26 into the ladder rung so that the second portion 18 and the paint can 12 may be separated from the ladder by a small distance to allow easier manipulation of the paint can holder 10. In order to provide such a shoulder, the first segment 28 has an outer diameter, illustrated at 36, of at least about $1\frac{1}{4}$ inches so that it does not fit within the typical hollow ladder rung and extends over a distance, illustrated at 38, which may be perhaps about 1 inch. If necessary, suitable knee supports (not shown) may be provided at the top and bottom of the first segment 28 for bracing the cantilevered handle portion 26 in accordance with principles commonly known to those of ordinary skill in the art to which this invention pertains.

The second portion 18, as well as portions 16, 20 and 22, has a width, illustrated at 42, which is large enough to accommodate the handle portion 26 but not so large that the curvature of the paint can 12 undesirably interferes with attaching the paint can holder 10 thereto. Thus, the width 42 may perhaps be about $1\frac{7}{8}$ inch.

Suitable chamfers 44 and 46 of perhaps about $\frac{1}{8}$ inch may be provided respectively between the first segment 28 and second portion 18 and between the first and second segments 28 and 30 respectively.

The second portion 18 desirably has a sufficient overall length, illustrated at 48, to not only accommodate the handle portion 26 but to provide sufficient reaction forces against the side of the paint can 12 to allow a stable attachment of the paint can holder 10 thereto. This length 48 is the distance which the second portion 18 extends downwardly along the outer surface of the paint can 12 from the rim 14 and may be perhaps about $3\frac{7}{8}$ inches. Second portion 18 has an upper segment 50 extending downwardly from the first portion 16 for a distance, illustrated at 52, which may be perhaps about 1 7/16 inches and has a thickness, illustrated at 54, which may be perhaps about 11/32 inch providing an outer surface 56 from which the handle portion 26 extends and providing an inner surface 58 which faces the paint can 12. References herein to the paint can are with the holder 10 attached as discussed herein. An enlarged thickness middle segment 60 of the second portion 18 is defined by an extension downwardly of the outer surface 56 to provide an outer surface thereof and further defined by an inner surface 62 which is inwardly, relative to the paint can, of surface 58 and spaced therefrom a distance, illustrated at 63, of about 3/32 to 5/32 inch to engage the outer surface of the paint can 12 whereby the upper inner surface 58 is spaced from the paint can 12 when the paint can holder 10 is attached thereto, as illustrated in FIG. 1. The enlarged thickness middle segment 60 may accordingly have a thickness, illustrated at 64, which may be perhaps about 7/16 to $\frac{1}{2}$ inch. Extending downwardly from the enlarged middle segment 60 is a lower segment 66 of reduced thickness which is defined by an extension downwardly of the inner surface 62 to provide an inner surface thereof and further defined by an outer surface 68. Lower segment 66 extends downwardly a distance, illustrated at 69, of perhaps about $1\frac{7}{8}$ inch. The outer surface 68 tapers toward the inner surface 62 so that the thickness of the lower segment 66 decreases to a lower thickness, illustrated at 72, of perhaps about 3/16 inch. Inner surfaces 58 and 62 are joined by a surface 74 which slants over a height, illustrated at 76, of perhaps about $\frac{1}{8}$ inch. Portion 18 may of course have other suitable configurations, and such other configurations are meant to come within the scope of the present invention. For example, surface 68 may be inwardly of surface 56 and joined by a slanted surface which is similar to surface 74.

The annular upper rims of paint cans are of generally standard size, having a height, illustrated at 88, which is less than their width radially, illustrated at 86. As will be discussed in greater detail hereinafter, advantage is taken of this property of paint can rims to provide reliable means of securely attaching the paint can holder 10 thereto so that the paint can holder 10 does not become inadvertently detached. As seen in FIG. 1, the portions 16, 20, and 22 substantially wrap around the rim 14 but the space between the end 24 of the fourth portion 22 and the inner surface of the paint can 12 is insufficient for the rim 14 to pass therethrough as long as the second portion 18 engages or runs alongside the outer surface of the paint can. During normal use when the paint can 12 is being held by the handle portion 26 either by holding in one's hands or by insertion in the hollow rung of a ladder, the second portion 18 reacts against and accordingly engages the paint can outer surface so that the paint can holder 10 cannot become disengaged. Only by setting the paint can 12 on a pavement or the like or otherwise holding the paint can and positively moving the paint can holder 10 through perhaps 45 to 90 degrees so that the handle portion 26 is oriented vertically or substantially toward a vertical position can the paint can holder 10 be removed by the narrow inner surface or height of the rim 14 passing through the space between the fourth portion end 24 and the second portion 18, i.e., by the rim passing width-wise through the space whereby incremental portions parallel to the annular inner surface of the rim pass consecutively through the space. In order to provide such secure attachment, the portions 16, 20, and 22, each having a thickness illustrated at 82 of perhaps about 3/16 inch, each has a length so that the rim 14 may be accommodated within the space illustrated at 84 between the portions 16, 18, 20, and 22 but not such that there is excessive free play, and the length of fourth portion 22 is small enough to allow sufficient space between its termination point 24 and the second portion 18 for passage of the rim width-wise yet long enough that the rim cannot pass height-wise therethrough, i.e., long enough that incremental portions parallel to the rim upper surface cannot pass through the space. For a typical one-gallon paint can, the length of the first portion 16 is such that the distance, illustrated at 90, between the second and third portions 18 and 20 respectively is perhaps about 13/16 inch, and the length of the third portion is such that the distance, illustrated at 92, between the first and fourth portions 16 and 22 respectively is equal to perhaps about 7/16 or $\frac{1}{2}$ inch. The length of the fourth portion 22 is such that its termination point 24 is spaced from the second portion 18 a distance, illustrated at 94, which may be perhaps about 7/16 inch. These dimensions 90, 92, and 94, which appear to be suitable for typical one gallon paint cans sold in both the U.S. and Canada, may vary some as long as they achieve substantially the same result and will of course vary for different size paint cans. With an understanding of the principles of the present invention, one of ordinary skill in the art to which this invention pertains will be able to appropriately dimension the paint can holder for other sizes of paint cans. If desired, the termination point 24 of portion 22 may be chamfered.

The handle portion first segment 28 is spaced from the upper surface of the first portion 16 a distance, illustrated at 96, which may perhaps be about $\frac{3}{8}$ inch so that it may be generally directly in line with the major stress whereby knee supports may not be required.

In order to attach the paint can holder 10 to the paint can 12, the paint can holder 10 is positioned with the handle portion 26 disposed substantially vertically and with the inner surface 58 of the second portion 18 substantially overlying the upper surface of the rim 14. With the paint can holder 10 in this position, it may be moved so as to receive the rim 14 width-wise in the space between the fourth portion termination point 24 and the second portion 18 followed by movement of the paint can holder 10 to the position shown in FIG. 1 whereby the rim 14 is received within the space 84 with assurance against inadvertent detachment thereof from the paint can 12, yet the paint can holder may be just as easily detached by deliberate actions of moving the paint can holder 10 back to the position where its handle portion 26 is oriented substantially or toward vertically and passing the rim width-wise through the space between the fourth portion termination point 24 and the second portion 18. Thus, there may be provided in accordance with the present invention a low cost non-complicated easy to use yet rugged and reliable paint can holder for a do-it-yourself or professional painter.

While the paint can holder 10 as so far described may be suitably mounted to ladders by insertion of the handle segment 30 within a hollow rung thereof, not all ladders may have hollow rungs whereby it may be desired to mount the holder 10 to a ladder by some other means. In accordance with the present invention, referring to FIGS. 4 to 6, there is provided such a means, illustrated generally at 100, which is a member attachable to a step-ladder top plate, illustrated at 102, as will be described hereinafter, or other suitable portion of a ladder, and positions an elongate cylindrical portion 104 for engagement with the paint can holder handle portion 26. Referring to FIG. 3, the handle portion second segment 30 is preferably hollow and has a cylindrical inner surface 106 extending over the length thereof for receiving the cylindrical portion 104. Thus, the cylindrical portion 104 may have a length, illustrated at 112, of perhaps about $5\frac{1}{4}$ inches for insertion within the hollow handle portion 26. The cylindrical portion may have a diameter, illustrated at 108, of perhaps about 11/16 inch, and the inner surface 106 of the handle segment 30 may have a diameter, illustrated at 110, of perhaps about 25/32 inch to provide a suitable fit therebetween. Thus, the difference in the diameter 108 of the cylindrical portion 104 and the diameter 110 of the handle portion inner surface 106 should be such, i.e., perhaps about 3/32 inch, to provide a snug fit between the handle portion 26 and the cylindrical portion 104 but not so tight that manipulation thereof is difficult.

A ladder engaging portion 114 as well as cylindrical portion 104 is attached to a flat backing plate 116 by screws 118 and 120 respectively or by other suitable means. Member 100 including the cylindrical portion 104 is a rigid member composed of a suitable material which may desirably be injection molded as a single piece. The material of which member 100 is composed may be similar to the material of which paint can holder 10 is composed.

Backing plate 116 may have a generally rectangular bottom section 122 to which the ladder engaging portion 114 is attached and a generally rounded triangular upper section 124 to which the cylindrical portion 104 is attached generally centrally thereof, as best illustrated in FIG. 6. The rectangular section 122 may have a width, illustrated at 126, of perhaps about 2 inches and a height, illustrated at 128, of perhaps about $1\frac{3}{4}$ inches, and the triangular section 124 may have a height, illustrated at 130, of perhaps about 1 inch to suitably accommodate the ladder engaging portion 114 and the cylindrical portion 104 respectively. Plate 116 may have a thickness, illustrated at 132, of perhaps about 5/32 inch. As shown in FIG. 4, both the ladder engaging portion 114 and the cylindrical portion 104 extend from the same side of the plate 116 in the same direction and are spaced apart a distance, illustrated at 164, which may be perhaps between about $\frac{1}{8}$ and $\frac{1}{4}$ inch and tapering toward each other toward the plate 116 to snugly receive therebetween the thickness, illustrated at 166, of the handle segment 30 of perhaps about $\frac{1}{8}$ inch.

The ladder engaging portion 114 may have a thickness, illustrated at 134, of perhaps about 5/32 inch and a width, illustrated at 136, which is equal to substantially the width 126 of the rectangular section 122.

Step-ladder top plate engaging portion 114 has a first section 138 which engages the rectangular section 122 and is attached thereto by screws 118 or other suitable means, a second section 140 extending from the first section end which is closest to the cylindrical portion 104 outwardly normal to the plate 116 and generally parallel to the cylindrical portion 104, with the aforementioned slight taper, and which extends beyond the end of the cylindrical portion 104 to an end from which a third section 142 extends normal thereto in a direction parallel to the first section 138 and in a direction away from the cylindrical portion 104. This third section 142 terminates at point 144. A fourth section 146 extends from the other end of the first section 138 obliquely thereto and toward the second section 140 to terminate at a point 148.

The length, illustrated at 150, of the third section 142 and the distance, illustrated at 152, between the fourth section termination point 148 and the second section 140 are selected to accommodate the thickness, illustrated at 154, of the standard step-ladder top plate snugly. Thus, length 150 may be perhaps about 11/16 inch, and distance 152 may be perhaps about $\frac{3}{4}$ inch. The distance, illustrated at 168, between the first and third sections 138 and 142 respectively is selected to allow the first and third sections to snugly receive and securely embrace the ends of a standard step-ladder top plate having a standard length therebetween. Thus, the distance 168 may perhaps be about $5\frac{5}{8}$ inches. Since the third section is provided to securely embrace an end of the step-ladder top plate 102, its length 150 may vary substantially. The top plate engaging surface of the third section 142 may be grooved as illustrated by groove 156 or serrated to better engage the end of the top plate 102. Thus, the member 100 may be snugly and securely attached to a top plate of a wooden step ladder by engaging the top plate between the first and third sections 138 and 142 respectively and between the fourth section termination point 148 and the second section 140.

Some step ladders with top plates having the standard thickness 154 may have a skirt attached at one end to extend downwardly therefrom for a standard distance. Such a skirt is illustrated at 158 in FIG. 4. The distance, illustrated at 160, along the first section 138 between the second and fourth sections 140 and 146 respectively and the angle, illustrated at 162, which the fourth section 146 forms with the first section 138 are selected to accommodate the skirt 158 and to permit insertion of the skirt 158 into the space between the second and fourth sections 140 and 146 respectively by orienting the member 100 with second section 140 at an angle to plate 102 and gradually re-orienting the second section to engage the plate 102 along the length thereof as the first section is gradually positioned to engage the skirt 158 such that a snug fit is obtained. Thus, the distance 160 may be perhaps about $1\frac{1}{2}$ inch, and the angle 162 may perhaps be about 45 degrees.

Although step-ladder top plate engaging member 100 is described as being composed of a rigid material, there may be some slight flexion therein such as between cylindrical portion 104 and plate 116. As previously discussed, although the step-ladder top plate engaging member 100 is shown to be composed of three portions connected together, which may simplify manufacture, it should be understood that it may desirably be composed as a single piece. The dimensions provided herein are for a particular size step-ladder top plate and may vary as long as substantially the same result is achieved. For top plates having other sizes, the dimensions will vary accordingly and can be selected for a particular top plate size in accordance with the present invention using principles commonly known to those of ordinary skill in the art to which this invention pertains.

Thus, there is provided in accordance with the present invention a kit comprised of two low cost non-complicated easy to use members which allow a paint can to be readily and effectively and securely mounted to a variety of standard ladders for use easily and reliably by the do-it-yourself as well as the professional painter.

Figure 9:
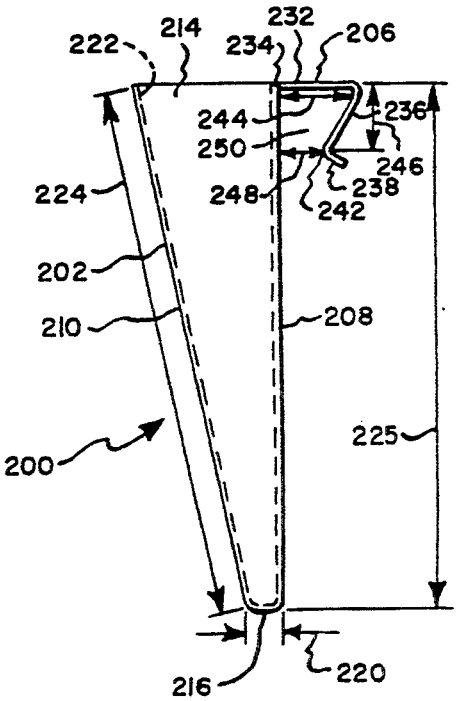
FIG. 9 is an enlarged side view of the paintbrush holder of FIG. 7.

During climbing of a ladder for painting, the user's safety may be increased if the paintbrush is secured with the paint can so that he or she has a free hand. It is also often desirable during painting activities to lay the brush aside for a while such as while having lunch in such a way that the bristles of the brush do not dry out but instead remain moist and in shape for resumption of painting. Referring to FIGS. 7 to 10, there is shown generally at 200 a paintbrush holder, which may be of low cost, non-complicated, easy to use, reliable, and effective for achieving both of the above objects. The paintbrush holder 200 includes a housing portion 202 for the paintbrush 204 and a clip or attachment portion 206 which clips the housing 202 to the rim 14 of the paint can 12. The housing 202 is preferably of a single-piece injection or blow molded construction. While the clip 206 may be molded integrally therewith, as shown, it may alternatively be manufactured separately to simplify the molding operation as well as to allow the clip to be composed of a different material. A suitable recess may be molded in the outer surface of the housing 202 to accept the separate clip, which may then be suitably attached such as with a suitable adhesive. The housing includes a generally rectangular rear wall 208 for engaging the side of the paint can 12, a generally rectangular front wall 210, and a pair of generally triangular side walls 212 and 214 whereby the rear and front walls 208 and 210 respectively converge toward the bottom, and the walls 208, 210, 212, and 214 are connected at the bottom to form a narrow bottom wall 216 wherein the intersections of the rear and front walls 208 and 210 respectively are chamfered, as shown in FIG. 9, such that the bottom wall 216 is generally rounded in shape. The rounded bottom wall is suitably sized for receiving the tips of the paintbrush bristles 218 so that the desired normal shape of the bristles 218 for painting may be maintained by the tapered walls and narrow rounded bottom while the brush 204 is received in the housing 202. Thus, the bottom wall 216 may have a width, illustrated at 220, which may be perhaps about $\frac{3}{8}$ inch. The walls 208, 210, 212, and 214 define an open upper end, illustrated at 222, for receiving the paintbrush 204 therein. Each of the four vertical corners are chamfered at perhaps a $\frac{1}{4}$-inch chamfer as illustrated at 230 in FIG. 8.

When a paintbrush is put down across the top of a paint can for temporary cessation of painting, this "free air" practice may allow fast drying paint which is now commonly used to begin to harden the bristles of the brush immediately so that they may no longer be moist after perhaps 20 minutes. This has been a problem with painters for a long time. In order to retard the passage of air to the bristles 218 so that the moistness thereof may be maintained for a longer period of time of perhaps more than 1 hour, in accordance with the present invention the housing 202 is composed of an air impermeable sheet material such as, for example, high density polypropylene, which may have a thickness of perhaps about 1/32 inch. Alternatively, the housing 202 may be composed of aluminum sheet stock so that it is disposable. Although the housing 202 is preferably of single-piece construction, it may be composed of more than one piece of air impermeable material suitably attached so that air is retarded from passing into the housing 202. In order to further retard the passage of air to the bristles 218, the height of the housing 202 and the size of the opening 222 are suitably selected so that the bristle housing 254 substantially fills, or blocks to the passage of air, the open upper end 222, as illustrated in FIG. 7. Thus, for brush sizes $1\frac{1}{2}$ inches to 4 inches, the tapered front wall 210 may have a length, illustrated at 224, which is equal to about 5 inches, and the wall 208 may have a length, illustrated at 225, which is equal to about $4\frac{3}{4}$ inches. The width, illustrated at 226, of the opening 222 may perhaps be about $1\frac{1}{2}$ inches. The length, illustrated at 228, of the opening 222, i.e., width of the front and rear walls, will vary depending upon the size of the brush such as about $2\frac{5}{8}$ inches for a $1\frac{1}{2}$inch brush, $3\frac{1}{4}$ inches for a $2\frac{1}{2}$ inch brush, $4\frac{1}{8}$ inches for a $3\frac{1}{2}$ inch brush, and 5 inches for a 4 inch brush.

Thus, by placing the brush 204 with its wet bristles 218 in the housing 202 composed of air impermeable material with the bristle housing 254 retarding air flow to the bristles through the open upper end, the wetness of the bristles 218 may be maintained for a long temporary period of perhaps more than 1 hour and their shape maintained by the narrow rounded bottom wall 216 and the taper therefrom of the rear and front walls 208 and 210 respectively so that the brush 204 may be maintained in condition for resumption of painting perhaps more than 1 hour later by a do-it-yourself or professional painter.

In order that the housing 202 may be securely attached to a paint can so that it is easily attached but yet does not inadvertently become detached, in accordance with the present invention the clip 206, as described hereinafter, is provided for clipping the paintbrush holder 200 to the paint can rim 14. The clip 206 includes a first portion 232 which extends from the upper edge 234 of the rear wall 208 generally centrally thereof and generally normal thereto to generally engage or extend alongside the upper surface of the rim 14 with the housing 202 hanging alongside the outer surface of the paint can. A second portion, illustrated at 236, extends downwardly from the outer end of the first portion 232 and inwardly toward the rear wall 208 to a point, illustrated at 242, from which a third portion 238 hooks outwardly or away from the rear wall 208 a distance of perhaps 3/16 inch. The clip 206 is sized to snugly surroundingly engage or contain the rim 14 with the opening, illustrated at 248, to the clip between the point 242 and the rear wall 208 being sufficient to receive the inner surface 88 of the rim 14 width-wise but small enough that the rim does not pass therethrough height-wise so that the paintbrush holder 200 cannot become inadvertantly detached while the housing 202 is hanging along the outer side of the paint can 12. In order to achieve such a result for a standard rim sold in the U.S. or Canada, the first portion 232 has a length such that the distance, illustrated at 244, between the second portion 236 and the rear wall 208 at the point where the second portion 236 attaches to the first portion 232 is selected to be perhaps about $\frac{5}{8}$ or 11/16 inch. The second portion 236 extends downwardly a distance, illustrated at 246, which is equal to about $\frac{1}{2}$ or 9/16 inch and extends inwardly toward the rear wall 208 so that at its bottom end point 242 it is spaced from the rear wall 208 a distance, illustrated at 248, which is equal to perhaps about 5/16 or ⅜ inch. Thus, while the length 244 of the first portion 232 is sufficient to engage the upper surface of the rim 14 whereby the rim may be received within the space 250 within the clip 206, the opening 248 to the clip is insufficient for height-wise passage of the rim. However, since the inner circumferential surface of the rim 14 has a height 88 which is less than the width 86, the rim can pass through the opening 248 width-wise. Therefore, to clip the paint brush holder 200 to the paint can 12, it is positioned with the rear wall 208 substantially oriented to rest on top of the rim, i.e., with the rear wall 208 at an angle of perhaps 45 to 90 degrees relative to the paint can side. The holder 200 is then moved so that the rim passes width-wise through the opening. The paintbrush holder is then rotated through about 45 to 90 degrees to hang alongside the outer surface of the paint can. The small opening size 248 prevents the paintbrush holder from thereafter inadvertently becoming disengaged by merely pulling up on it since the radial width of the rim is too large for the opening 248. In order to disengage the paintbrush holder 200, it must again be moved to that orientation for passage of the rim width-wise through the opening. In order to ease the engagement and disengagement of the paintbrush holder 200, the clip 206 may be composed of a material such as PVC, aluminum, or spring steel so that is has some flexibility. Thus, the paintbrush holder 200 may be fastened to the paint can rim 14 by positioning the paintbrush holder horizontally or substantially horizontally with the top of the paint can and with an outward-downward action the clip becomes secured to the rim. While the paintbrush holder 200 may not be inadvertently detached, it may be easily detached by the use of an upward and inward action to release the clip so that the brush holder may be washed and put away. Thus, the paintbrush holder 200 is securely clipped to the rim of a paint can so that it may not become inadvertently detached during use and yet may be attached easily and effectively.

The width, illustrated at 252, of the clip 206 should be small enough that the curvature of the rim does not unduly interfere with its ease of use. For example, width 252 may perhaps be about 1 to 1⅛ inch. As the width 252 is increased, the lengths 244 and 246 may also have to be increased due to the effects of rim curvature, and such changes can be made using principles commonly known to those of ordinary skill in the art to which this invention pertains.

Thus, there is provided a low cost, easy to use, effective, and reliable receptacle for a paintbrush wherein it may remain safe and secure while staying moist for a long period of time of perhaps more than an hour, and the tapering walls are provided to maintain the bristles of the brush shaped for good painting, i.e. no more flared bristles to splatter paint as may be the result when a brush is merely laid down in the open. Such a brush holder provides convenience in that one always knows where to put the brush and where it is when it is time to use it again. It provides safety in that, when the brush is in the holder, it cannot be knocked into the paint or off the work area completely. Thus, it reduces the danger of one instinctively reaching out and trying to grab a falling paintbrush resulting perhaps in loss of balance, a foot slipping, or the ladder falling.

Due to the curvature of the rim, it should be noted that neither the paint can holder nor the paintbrush holder can be secured to the paint can rim so that they are disposed inside the paint can.

Figure 11:
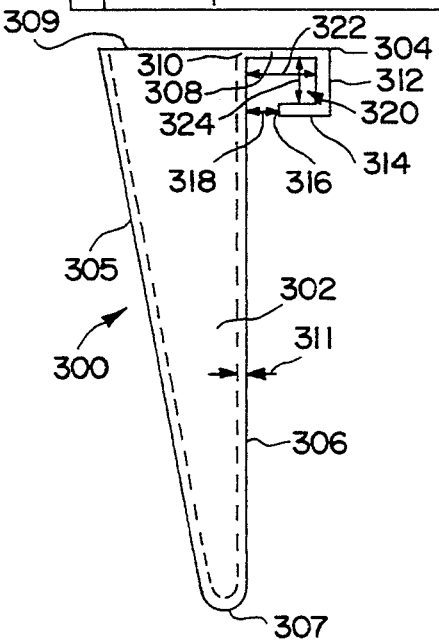
FIG. 11 is a view similar to that of FIG. 9 of an alternative embodiment of the paintbrush holder.

Referring to FIG. 11, there is shown generally at 300 a paintbrush receptacle having a housing portion 302 with front and rear walls 305 and 306 respectively, side walls (not shown), a bottom wall 307, and an upper opening 309, which is similar to the housing portion 202 of the embodiment of FIGS. 7 to 10, and a clip 304 rigidly and preferably integrally connected to the upper edge of its rear wall 306. The housing thickness, illustrated at 311, may typically vary between about 1/32 and 1/16 inch depending on the material of which it is composed.

If the housing 302 and the clip 304 were to be made separately, the housing 302 may possibly be blow-molded and the clip 304 injection-molded, a slight indentation being made in the housing 302 to accept the clip 304 and a suitable adhesive applied for permanent attachment.

The clip 304, which is similar in shape to the paint can holder clip of FIGS. 1 to 3, has an elongate first portion 308 which is generally normal to the rear wall 306 and which extends outwardly from the upper rear wall edge 310 for engaging an upper surface of the upper lid engaging inwardly projecting rim (shown at 14 in FIG. 1) of a paint can similarly as it is engaged by portion 16 in FIG. 1. An elongate second clip portion 312 is substantially normal to the first portion 308 and extends downwardly from an outer end thereof and generally parallel to the rear wall 306 for engaging the inner surface of the rim 14 similarly as the rim inner surface is engaged by portion 20 in FIG. 1. An elongate third clip portion 314 is substantially normal to the second portion 312 and extends from the lower end of portion 312 inwardly toward the rear wall 306 and generally parallel to first portion 308 to engage the lower surface of the rim 14 similarly as the rim lower surface is engaged by portion 22 of FIG. 1. The space, illustrated at 320, between portions 308, 312, and 314 and the rear wall 306 thus defines a containment for the rim 14. The third portion 314 terminates at an end 316 which is spaced from the rear wall a distance, illustrated at 318, to define between the third portion end 316 and the rear wall 306 means for receiving the rim 14 within the containment 320.

For a single-piece receptacle construction using 1/16 inch material, the clip 304 may, for example, have a width, similarly as width 252, equal to perhaps about 1⅛ inches; the distance, illustrated at 322, which the second portion 312 is spaced from the rear wall 306 may perhaps be about ¾ inch; the distance, illustrated at 324, which the first and third portions 308 and 314 respectively are spaced apart may perhaps be about 7/16 inch; and the distance 318 may perhaps be about ⅜ inch, all angle bends having perhaps 1/16 inch chamfer.

Paintbrush receptacle 300 may be securely attached to a paint can and detached therefrom in a similar manner as paint can holder 10 is attached and detached from a paint can. The receptacle 300 is thus initially positioned with the rear wall 306 normal or toward normal, to the extent necessary, to the paint can side and generally overlying the rim upper surface, then moved to receive the rim widthwise in the space between the third portion termination point 316 and the rear wall 306 followed by movement of the receptacle 300 so that the rear wall 306 engages the side of the paint can whereby the rim 14 is received within the containment 320 with assurance against inadvertent detachment thereof from the paint can 12, yet the receptacle 300 may be just as easily detached by deliberate actions of moving it back to the position where the rear wall 306 is oriented substantially or toward normal to the paint can side and passing the rim 14 widthwise through the space between third portion termination point 316 and the rear wall 306. Thus, there may be provided in accordance with the present invention a low-cost non-complicated easy to use yet rugged and reliable paintbrush receptacle for a do-it-yourself or professional painter.

Figure 12:
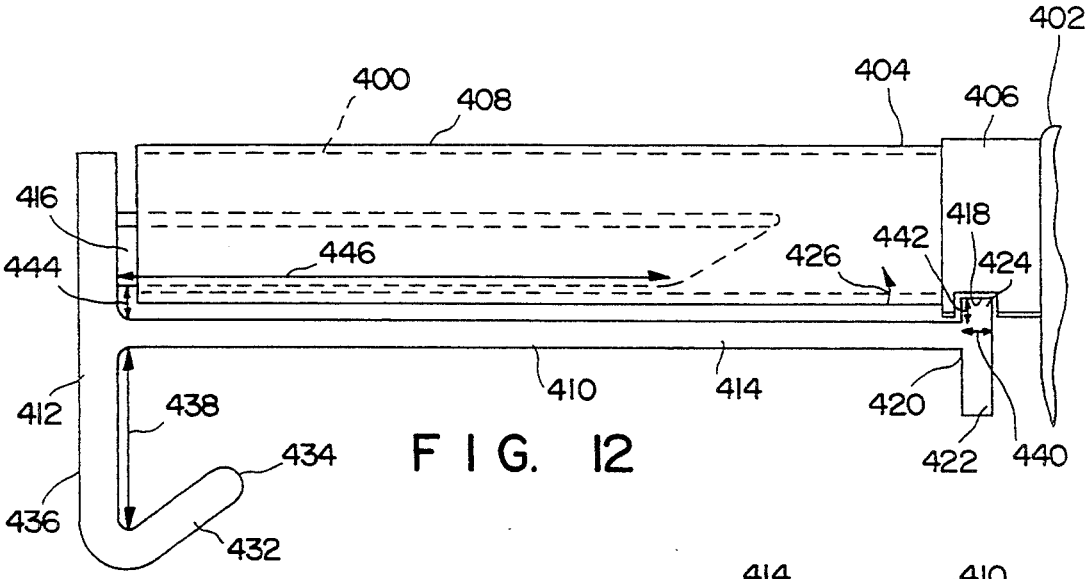
FIG. 12 is a partial side view of an alternative embodiment of the apparatus of FIGS. 1 and 4 in combination.
Figure 14:
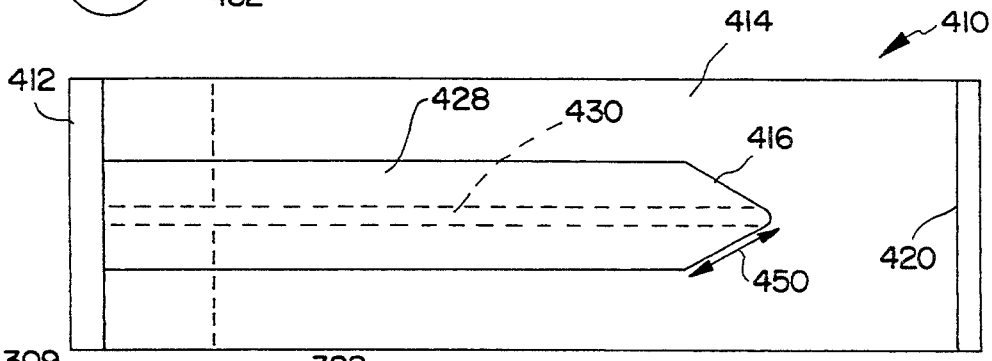
FIG. 14 is a top view of the member of FIG. 13.
Figure 13:
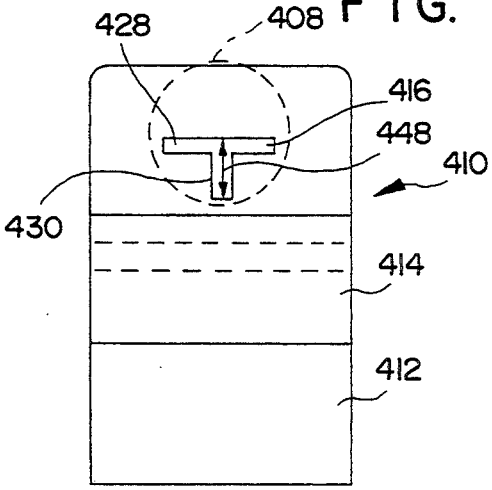
FIG. 13 is an end view of the alternative embodiment (shown in FIG. 12) of the member of FIG. 4.

Referring to FIGS. 12, 13, and 14, there is shown an alternative embodiment of the combination of the paint can holder 10 and ladder adapter 100. In accordance with this alternative embodiment there is provided a paint can holder 400 with first, third, and fourth portions (not shown) similar to first, third, and fourth portions 16, 20, and 22 respectively of the embodiment of FIGS. 1 to 3, and a second portion 402 and handle portion 404 similar to second portion 18 and handle portion 26 respectively, except as discussed hereinafter, the handle portion 404 having first and second segments 406 and 408 respectively similarly as handle portion 26 has first and second segments 28 and 30 respectively.

There is also provided for use with the paint can holder 400 a ladder adapter 410 which has a backing plate 412 similar to backing plate 116 to which are attached a step-ladder top plate 414 and an elongate paint can holder engaging portion 416, similar to top plate 102 and portion 104 respectively, except as discussed hereinafter. The adapter 410 may be molded as a single piece or otherwise suitably constructed.

In order to "latch" the paint can holder 400 to the adapter 410 to prevent accidental disengagement therefrom, the first handle segment 406 has a groove or slot, illustrated at 418, in the lower portion of the circumferential surface thereof, the axis of the slot being generally parallel with the second portion 402. The top plate 414 is formed to provide, at its end opposite the backing plate 412, section 420 which has a downwardly extending portion 422, similar to section 142, and an upwardly extending portion 424 which is sized and positioned to be latchingly received in slot 418 when second handle segment 408 is received by portion 416 as shown in FIG. 12.

In order to allow some slight upward movement, as illustrated at 426, of first handle segment 406 relative to top plate end section 420 for latching and unlatching the assembly, the length of portion 416 is shortened so that it terminates short of slot-engaging portion 424, and portion 416 is "T-shaped" in cross-section, as shown in FIG. 13, to generally engage the inner surface of second handle segment 408 at three points, i.e., along each of the sides and the bottom, as illustrated by the dashed line in FIG. 13. Thus, a horizontal portion 428 thereof has a length equal generally to the inner diameter of second handle segment 408 to engage opposite sides thereof, and a vertical leg 430 extends from the center of horizontal portion 428 downwardly to engage the bottom thereof in order to allow sufficient play between second handle segment 408 and adapter portion 416 for latching and unlatching the paint can holder 400 from the adapter 410.

The following dimensions are for illustrative purposes only and not for purposes of limitation. The overall length, width, and height of the adapter 410 may perhaps be about 5 15/16 inches, 1 11/16 inches, and 2 11/16 inches respectively. The termination point 434 of backing plate section 432 is spaced from top plate 414 a distance of perhaps about $\frac{3}{4}$ inch and is spaced from the vertical backing plate portion 436 a distance equal to perhaps about $\frac{5}{8}$ inch. The distance illustrated at 438 is equal to perhaps about 1 3/16 inches but can be as much as $1\frac{1}{2}$ inches. The backing plate 412 has a thickness of perhaps about $\frac{1}{4}$ inch, and the top plate 414 as well as section 420 thereof, including slot-engaging portion 424, has a thickness, illustrated at 440, which is equal to perhaps about 3/16 inch, the overall height of top plate end section 420 being perhaps about 13/16 inch. The height, illustrated at 442, of the slot-engaging portion 424 may perhaps be about 3/16 inch. The top plate 414 is spaced from portion 416 a distance, illustrated at 444, which is equal to perhaps about $\frac{1}{4}$ inch to receive the wall of second handle segment 408 with some play. The overall length of portion 416 may perhaps be about $4\frac{3}{8}$ inches with the end of leg 430 chamfered so that the length, illustrated at 446, of the lower edge of the leg 430 is perhaps about $3\frac{3}{4}$ inches. The overall height, illustrated at 448, of portion 416 may perhaps be about $\frac{1}{2}$ inch. The length of horizontal portion 428 may perhaps be about 21/32 inch, and the thickness of each of the horizontal and vertical portions 428 and 430 respectively may perhaps be about $\frac{1}{8}$ inch. The horizontal portion 428 terminates generally at a point, the distance, illustrated at 450, being perhaps about $\frac{1}{2}$ inch. The slot 418 may have a depth of perhaps about 3/16 inch and a width slightly greater than width 440 to suitably latchingly receive portion 424.

The latching means may suitably be constructed otherwise than as shown. For example, portion 424 may be provided inwardly of portion 422 and may extend only partially across the width of plate 414.

Thus, there is provided, in accordance with the present invention, a painting kit comprised of three members which are low cost, effective, rugged, reliable, and easy to use for mounting a paint can to a variety of styles of ladders and for providing a receptacle for the paintbrush which affords safety and maintenance of the paintbrush in a suitably moist condition and with the bristles suitably shaped for painting for a long period of perhaps over an hour of temporary cessation of painting. Such a kit provides an effective approach to a long felt need, as demonstrated by the complicated or otherwise impractical or costly structures of the prior art.

While specific embodiments of the invention have been shown and described in detail to illustrate the application of the principles of the invention, it will be understood that the invention may be embodied otherwise without departing therefrom. For example, the various exemplary dimensions may vary as appropriate to the invention. The details herein are therefore to be interpreted as illustrative and not in a limiting sense.

What is claimed is:

1. Apparatus comprising a rigid first member including an elongate tubular portion receivable within an aperture of a ladder, an elongate portion to which said tubular portion is attached for engaging a paint can side, and means for removably attaching said first member to a paint can rim with said elongate portion disposed along the side of the paint can for holding the paint can with said tubular portion extending cantileverly from said elongate portion, the apparatus further comprising a second member including an elongate portion which is removably receivable within said tubular portion and means for removably attaching said second member to a ladder plate with said second member elongate portion disposed horizontally whereby a paint can may be mounted on a ladder by attaching the first member thereto and receiving the second member elongate portion within the tubular portion.

2. Apparatus according to claim 1 wherein said ladder plate attaching means comprises a first section which extends between first and second ends parallel to said second member elongate portion for engaging the ladder plate along a width thereof, a second section extending from said first end and normal to said first section in a direction away from said second member elongate portion to engage a first side of the ladder plate, a third section extending from said second end and normal to said first section in a direction away from said second member elongate portion to an end to engage a second side of the ladder plate including overhanging molding attached thereto, and a fourth section extending from said third section end toward said first section at an oblique angle and terminating at an end which is spaced from said first section a distance to allow passage of the ladder plate with overhanging molding therebetween.

3. Apparatus according to claim 2 wherein each of said tubular portion and said second member elongate portion has a length which is equal to at least about 5 inches, said third section extends from said first section a distance which is equal to about 1½ inches, said fourth section extends at an angle relative to said third section which is equal to about 45 degrees and terminates at a distance from said first section which is equal to about ¾ inch, and said second member elongate portion is spaced from said first section a distance which is equal to between about ¼ and ⅛ inch.

4. Apparatus according to claim 1 further comprising means for latching said first member to said second member.

5. Apparatus according to claim 4 wherein said latching means comprises means defining a slot in said tubular portion and means defining a portion on said second member which is positioned to be receivable in said slot means when the second member elongate portion is received within the first member tubular portion.

6. Apparatus according to claim 4 further comprising a paintbrush holder including a container composed of a material which is impermeable to air, said container comprising a front wall, a rear wall, a pair of side walls which are connected to said front and rear walls and which are substantially triangular shaped to define a convergence of said front and rear walls toward the bottom of said container, said front and rear walls being connected at the bottom to define a closed bottom wall, means defining an opening for receiving a paintbrush in said container through the container top with a bristle housing of the paintbrush substantially blocking the passage of air to the bristles and with the brush handle disposed generally above the opening, and means for clipping said container to a paint can upper rim with said container hanging along the outside of the paint can.

* * * * *